US007878839B2

(12) United States Patent
Cheng et al.

(10) Patent No.: US 7,878,839 B2
(45) **Date of Patent: *Feb. 1, 2011**

(54) SOCKET CONNECTOR HAVING BOTTOM HOLE REINFORCED WITH SIMPLIFIED METALLIC PLATES

(75) Inventors: Chih-Pi Cheng, Tu-Cheng (TW); Nan-Hung Lin, Tu-Cheng (TW); Hao-Yun Ma, Tu-Cheng (TW); Chi-Nan Liao, Tu-Cheng (TW); Liang-Kai Lee, Tu-Cheng (TW); Cheng-Ching Chien, Tu-Cheng (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

This patent is subject to a terminal disclaimer.

(21) Appl. No.: 12/468,070

(22) Filed: May 19, 2009

(65) Prior Publication Data

US 2009/0286409 A1 Nov. 19, 2009

(51) Int. Cl.
*H01R 4/50* (2006.01)

(52) U.S. Cl. ..... 439/342; 439/259

(58) Field of Classification Search ..... 439/259, 439/264, 265, 266, 268, 342
See application file for complete search history.

(56) References Cited

U.S. PATENT DOCUMENTS

| | | | | |
|---|---|---|---|---|
| 6,338,640 | B1 * | 1/2002 | Lin | 439/342 |
| 6,609,926 | B1 * | 8/2003 | Chen et al. | 439/342 |
| 6,712,634 | B1 * | 3/2004 | McClinton | 439/342 |
| 7,371,101 | B2 * | 5/2008 | He et al. | 439/342 |
| 2009/0280656 | A1 * | 11/2009 | Cheng et al. | 439/55 |

* cited by examiner

*Primary Examiner*—Thanh-Tam T Le
(74) *Attorney, Agent, or Firm*—Andrew C. Cheng; Wei Te Chung; Ming Chieh Chang

(57) ABSTRACT

An electrical connector (1) comprises a base (10) with a plurality of contacts (19) received therein, a cover (11) slidably mounted on the base (10), a protecting mechanism (12) comprises a cover plate (13) retained in the cover (11) and a bottom plate (14) retained in the base (10), a cam actuator (16) rotatably assembled to the base (10), the cover (11) and the protecting mechanism (12) for actuating the cover (11) to slid on the base (10), the bottom plate (14) comprises a first plate (142) and a second plate (141), the first plate (142) comprises a base portion (1421) and a first engaging portion (1422) extending curvedly from the end of the body portion (1421).

11 Claims, 7 Drawing Sheets

SOCKET CONNECTOR HAVING BOTTOM HOLE REINFORCED WITH SIMPLIFIED METALLIC PLATES

BACKGROUND OF THE INVENTION

1. Field of Invention

The present invention relates to an electrical connector, and more particularly to an electrical connector having a bottom plate with two separated parts assembled to the base.

2. Description of the Prior Art

A ZIF socket is often used to mount a PGA chip onto a printed circuit board (PCB). One example of the such connectors comprises a plastic base, a plastic cover mounted on the base, a plurality of electrical contacts received in the base, a metal cover plate insert molded in the cover, a bottom plate received in the base and a cam actuator for driving the cover slide along the base. The base defines a recess for receiving the bottom plate at one end thereof, and the bottom of the recess defines a through hole. The bottom plate, the cover plate and the cover each defines a through hole in alignment with the through hole of the base.

In assembly, the cam actuator goes through the through holes of the cover, the cover plate, the bottom plate and the base, then the cover, the cover plate, the base plate and the base can be assembled together. When the cam actuator is rotated, the cover can be driven to slide along the base to make the PGA chip in contact with the contacts of the ZIF socket, then make a good electrical connection between the PGA chip and the PCB. Due to the ZIF socket becoming smaller and smaller and the number of the contacts becoming more and more, the force exerted on the cam actuator is increased. Then, the force that the bottom plate exerts on the base is accordingly increased. Because only the edge of the bottom plate engages with the base, it would be difficult to disperse the force exerted on the base, so the base is easy to be damaged.

In view of the above, a new electrical connector assembly that overcomes the above-mentioned disadvantages is desired.

SUMMARY OF THE INVENTION

Accordingly, an object of the present invention is to provide an electrical connector that can make the force exerted on the base to disperse equably.

To fulfill the above-mentioned object, an electrical connector for using with a PGA (Pin Grid Array) chip comprises a base with a plurality of contacts received therein, a cover slidably mounted on the base, a protecting mechanism positioned between the cover and the base, and a cam actuator rotatably assembled to the base, the cover and the protecting mechanism for actuating the cover to slid on the base. The protecting mechanism comprises a cover plate retained in the cover and a bottom plate retained in the base, the bottom plate comprises a first plate and a second plate, the first plate comprises a base portion and a first engaging portion extending curvedly from the end of the body portion.

Other objects, advantages and novel features of the invention will become more apparent from the following detailed description when taken in conjunction with the accompanying drawings.

DETAILED DESCRIPTION OF THE PREFERRED EMBODIMENT OF THE INVENTION

Reference will now be made to the drawings to describe the present invention in detail.

Figure 1:
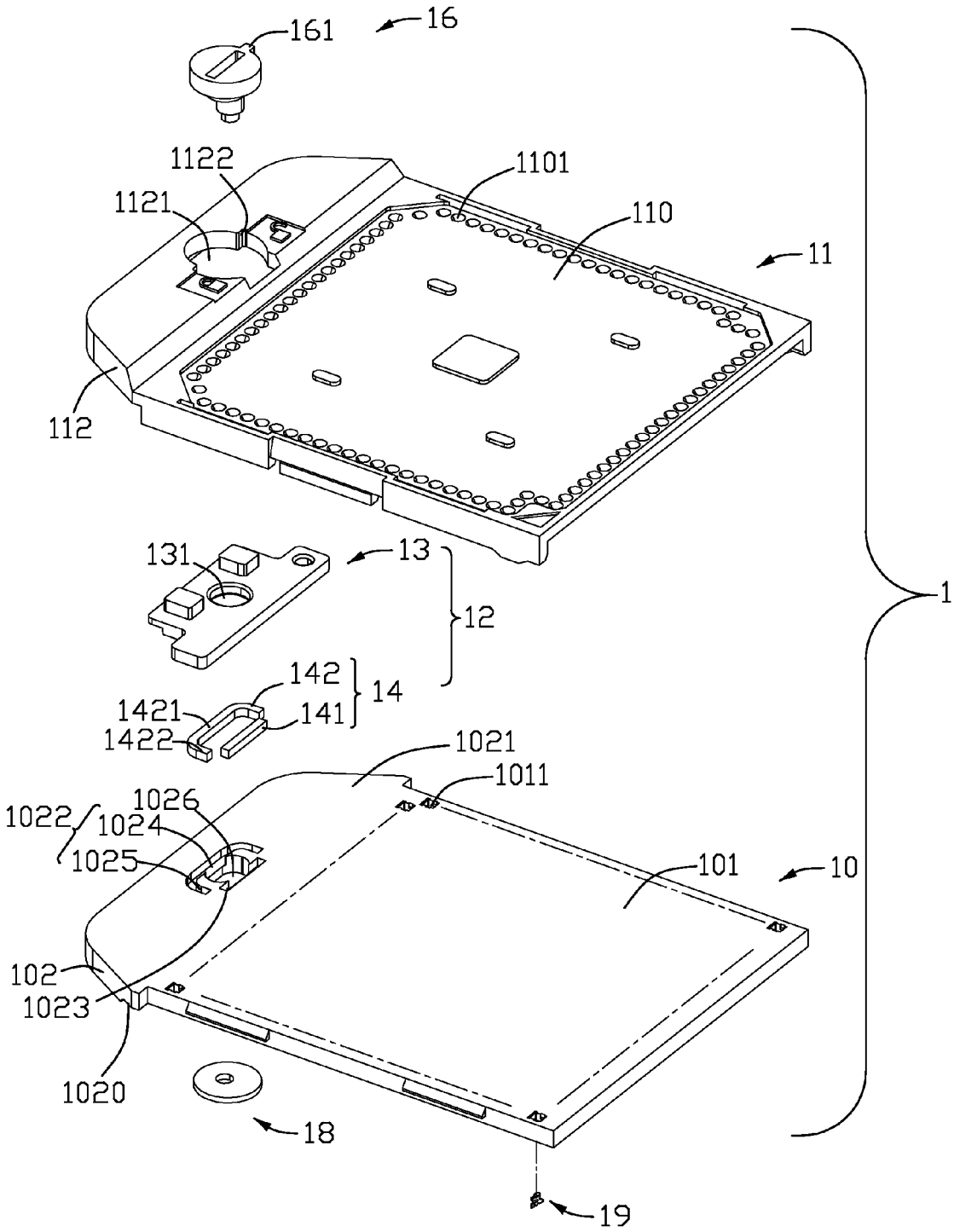
FIG. 1 is an exploded view of an electrical connector of a first embodiment of the present invention.
Figure 2:
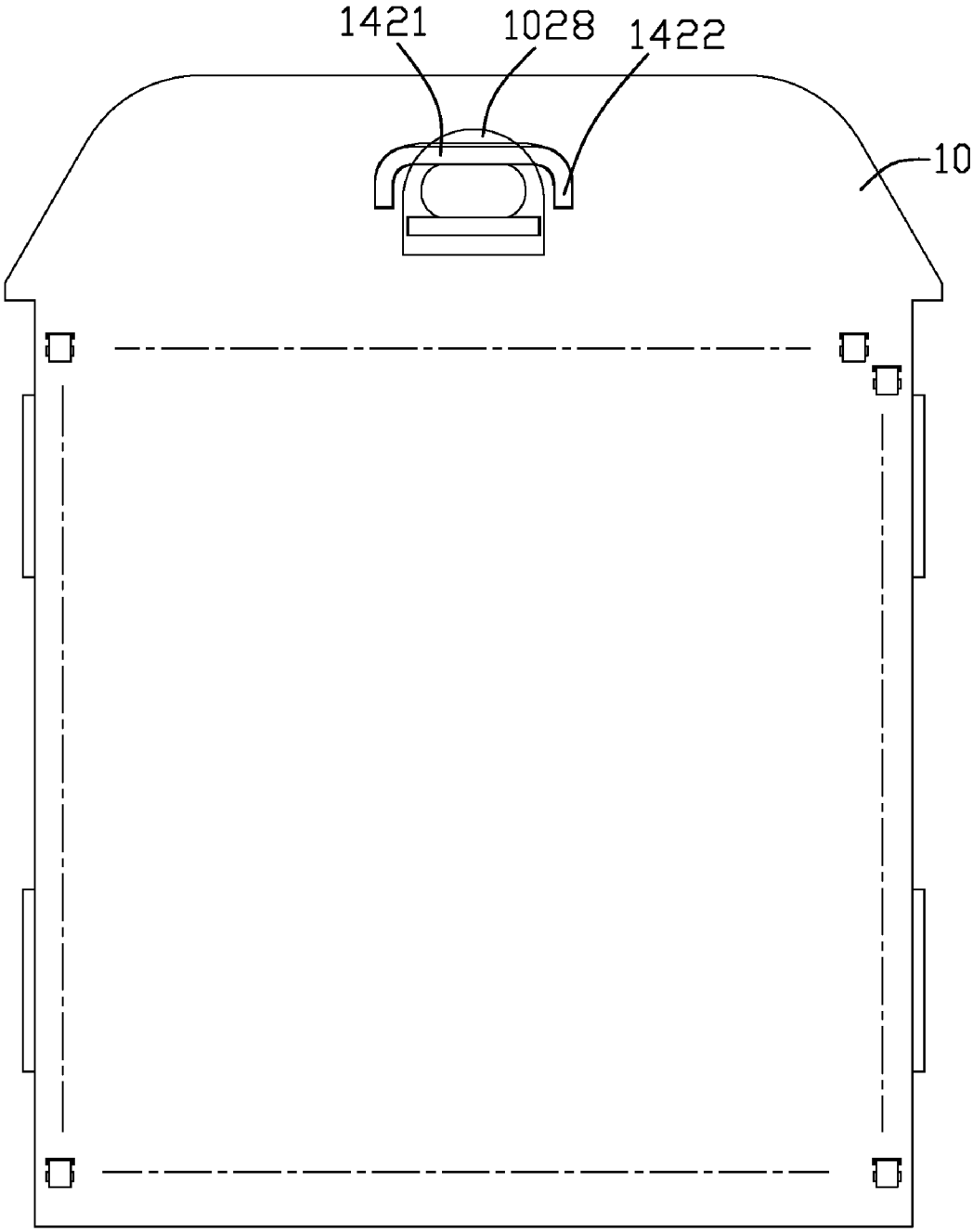
FIG. 2 is a top plane view of the base assembled with the bottom plate.
Figure 3:
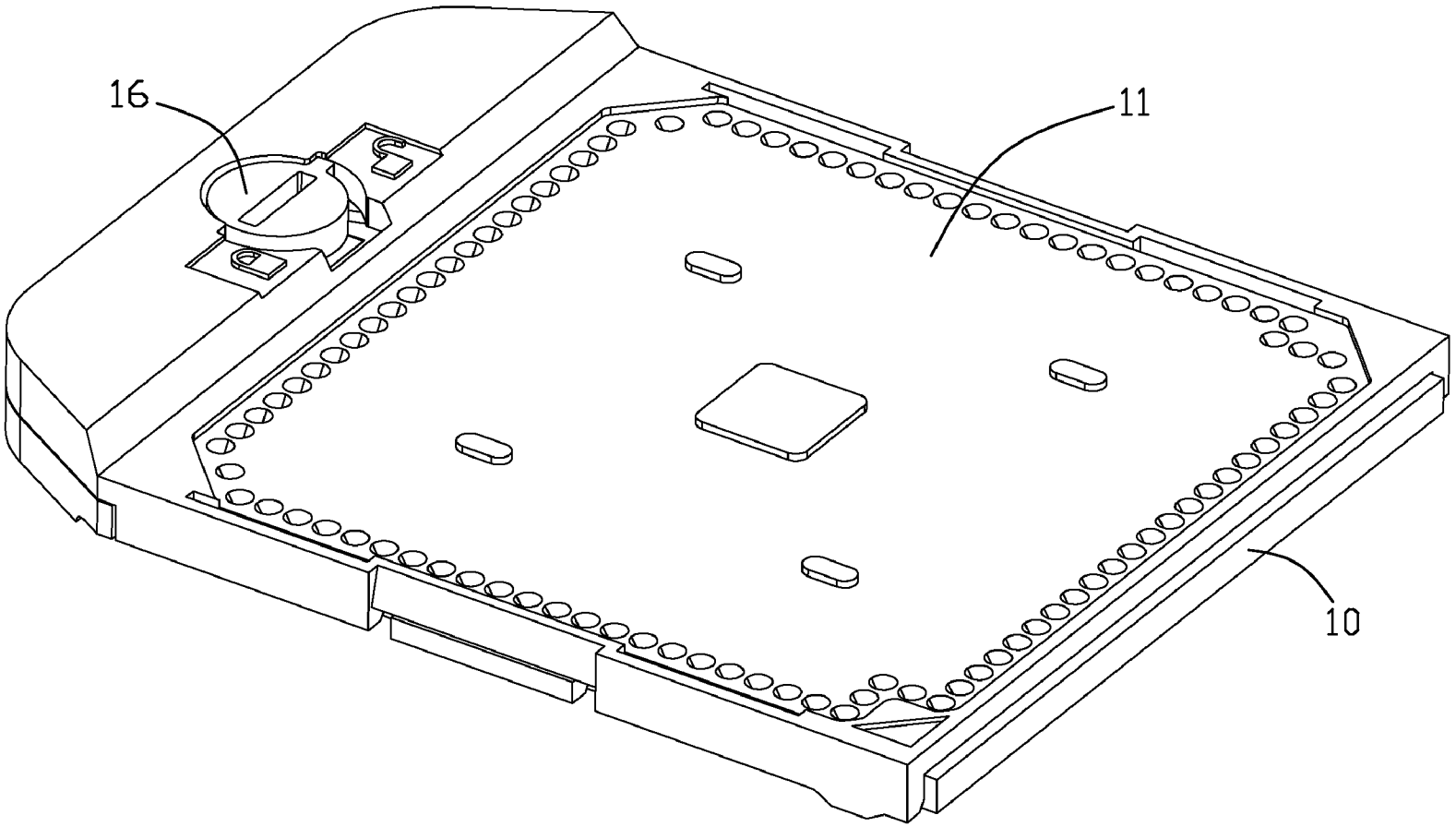
FIG. 3 is an assembled view of the electrical connector shown in FIG. 1.

Referring to FIGS. 1 to 3, an electrical connector 1 in according with the present invention is used for electrically connecting an electronic package, such as a pin grid array (PGA) chip (not shown), with a circuit substrate, such as a printed circuit board (PCB) (not shown). The electrical connector 1 comprises an insulative base 10, a dielectric cover 11, a plurality of contacts 19, a metallic cam actuator 16, a protecting mechanism 12 and a washer 18.

The base 10 is generally in the shape of a square and comprises a body portion 101 and an extending portion 102 extending from one end of the body portion 101. The body portion 101 defines a plurality of passageways 1011 extending vertically through the body portion 101 to receive the contacts 19. The extending portion 102 comprises a bottom surface 1020 near the PCB and an upper surface 1021 opposite to the bottom surface 1020. The middle of the upper surface 1021 defines a bottom hole 1026 impenetrate to the bottom surface 1020. The middle of the bottom surface 1020 defines a recess 1028 to receive the washer 18. The extending portion 102 also defines a U-shaped groove 1022 at one side of the bottom hole 1026 and a linear shaped channel 1023 at the other side of the bottom hole 1026, the groove 1022 and the channel 1023 are connected with the bottom hole 1026, but the groove 1022, the channel 1023 and the recess 1028 are disconnected with each other. The groove 1022 comprises a first groove 1024 paralleled with the channel 1023 and a pair of second groove 1025 extending to the channel 1023 from the two end of the first groove 1024.

The cover 11 has a shape corresponding to that of the base 10 and comprises a support portion 110 and a head portion 112 extending from one end of the support portion 110. The head portion 112 is higher than the support portion 110 and defines a top hole 1121 in the middle thereof in alignment of the bottom hole 1026 of the base 10. The top hole 1121 consists of two semicircle-shaped holes of different diameters. A pair of opposite stop walls 1122 are provided at the junction of the two semicircle-shaped holes. The support portion 110 defines a plurality of passages 1101 in alignment with the passageways 1011 of the base 10.

The protecting mechanism 12 comprises a T-shaped metal cover plate 13 insert molded in the cover 11 and a metal bottom plate 14 received in the base 10. The cover plate 13 defines a through hole 131 in alignment with the top hole 1121 of the cover 11. The bottom plate 14 comprises a first plate 142 received in the groove 1022 and a second plate 141 with a linear configuration received in the channel 1023. The first plate 142 comprises a base portion 1421 with a linear configuration and a pair of first engaging portions 1422 extending curvedly and downwardly from the two end of the base portion 1421. The first engaging portion 1422 make the first plate 142 have a feature of spring, when the first plate 142 is assembled to the groove 1022, the spring feature make the first plate 142 positioned in the groove 1022 securely. The cam actuator 16 is made of several eccentric cylinders and defines a protrusion 161 extends outwardly from the top end.

In assembly, the first plate 142 is received in the groove 1022 and the second plate 141 is received in the channel 1023 of the base 10. Second, the cover 11 together with insert molded cover plate 13 is assembled onto the base 10. Successively, the cam actuator 16 is mounted onto the electrical connector 1 from the top via the top hole 1121 and then through the through hole 131 and the bottom hole 1026. The end of the cam actuator 16 is riveted with the washer 18 assembled in the recess 1028 of the base 10, whereby the cam actuator 16, the cover 11, the base 10 and the washer 18 are assembled together.

In use, rotation of the cam actuator 16 will create a driving force to move the cover 11 along the base 10, thereby making the pins (not showing) of the PGA chip engage with the contacts 19 in the passageways 1011. To dismount the electrical connector 1, the cam actuator 16 is rotated in an opposite direction, thereby can disengage the pins of the PGA chip from the contacts 19 of the electrical connector 1 and allow the PGA chip to be removed from the cover 11.

There is a little gap between the base portion 1421 of the first plate 142 and the sidewall of the first groove 1024, so the major portion of the force that the first plate 142 exerted on the base 10 comes from the first engaging portions 1422. At the same time, the first engaging portions 1422 are located beyond the region of the recess 1028 in the horizontal direction. It is to say, the force is exerted on a thinner place of the base 10, which can prevent the damage of the base 10 due to the great force exerted by the first plate 142.

Figure 4:
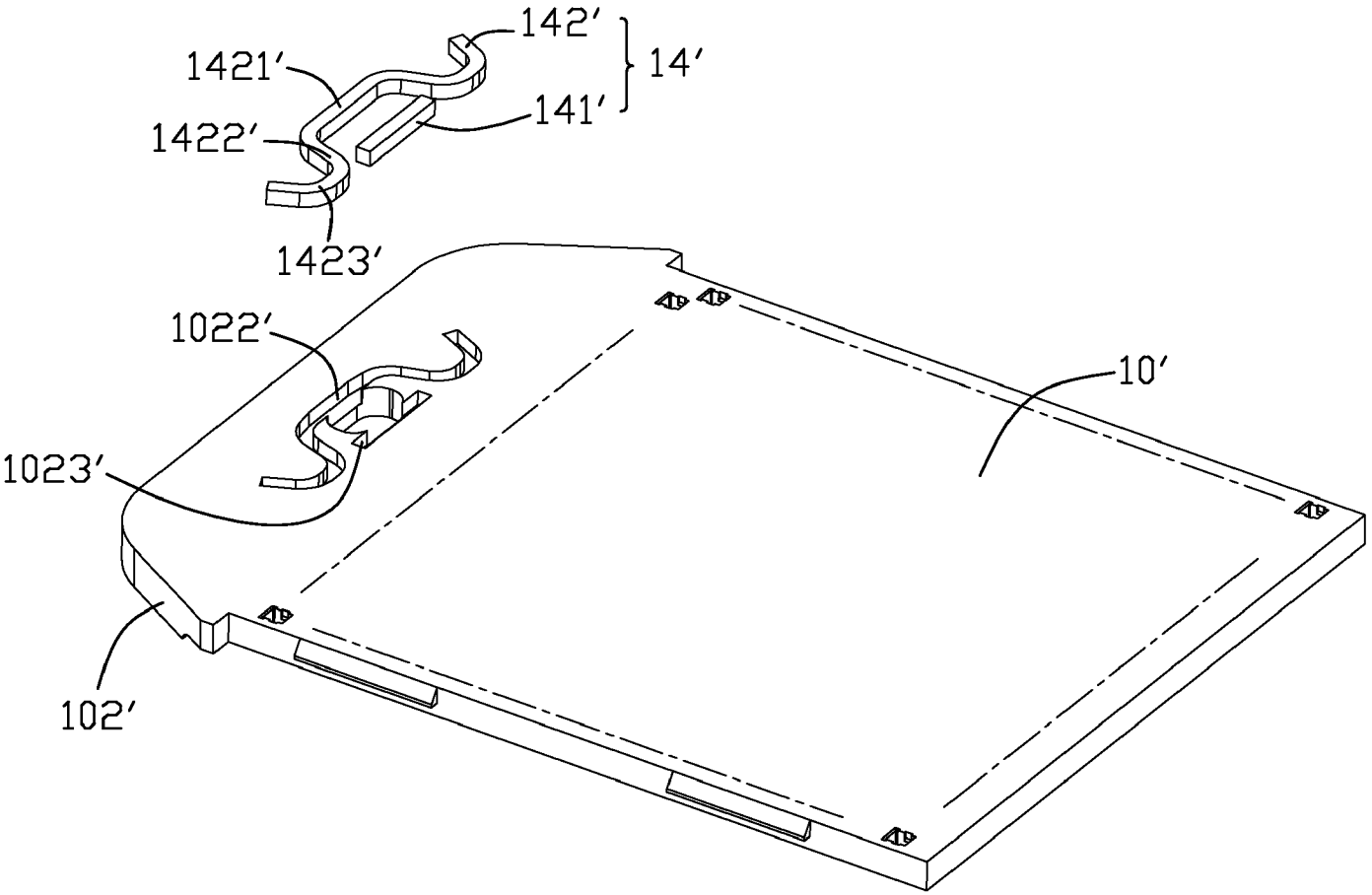
FIG. 4 is an exploded view of the base plate and the base of a second embodiment of the present invention.
Figure 5:
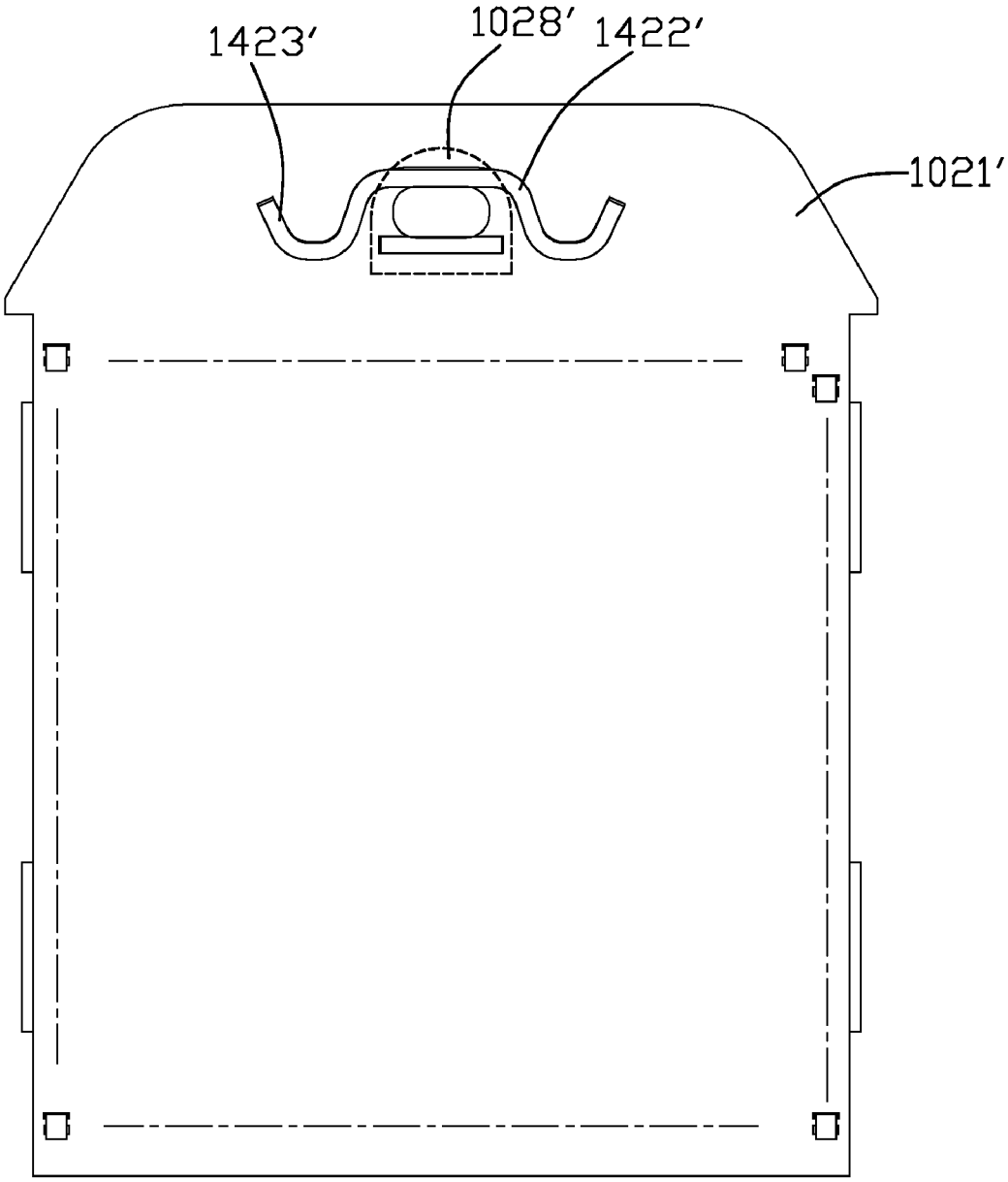
FIG. 5 is a top view of the base assembled with the bottom plate in FIG. 4.

Referring to FIGS. 4 to 5, showing a second embodiment of the present invention, which is similar to the first embodiment except the first plate 142' thereof further comprises a pair of second engaging portions 1423' extending curvedly and upwardly from the end of the two first engaging portions 1422'. When the first plate 142' is assembled into the groove 1022', the first engaging portion 1422' and the second engaging portion 1423' are both located beyond the region of the recess 1028' in the horizontal direction. It is to say, the force is exerted on a thinner place of the base 10', which can prevent the damage of the base 10' due to the great force exerted by the first plate 142'.

Figure 6:
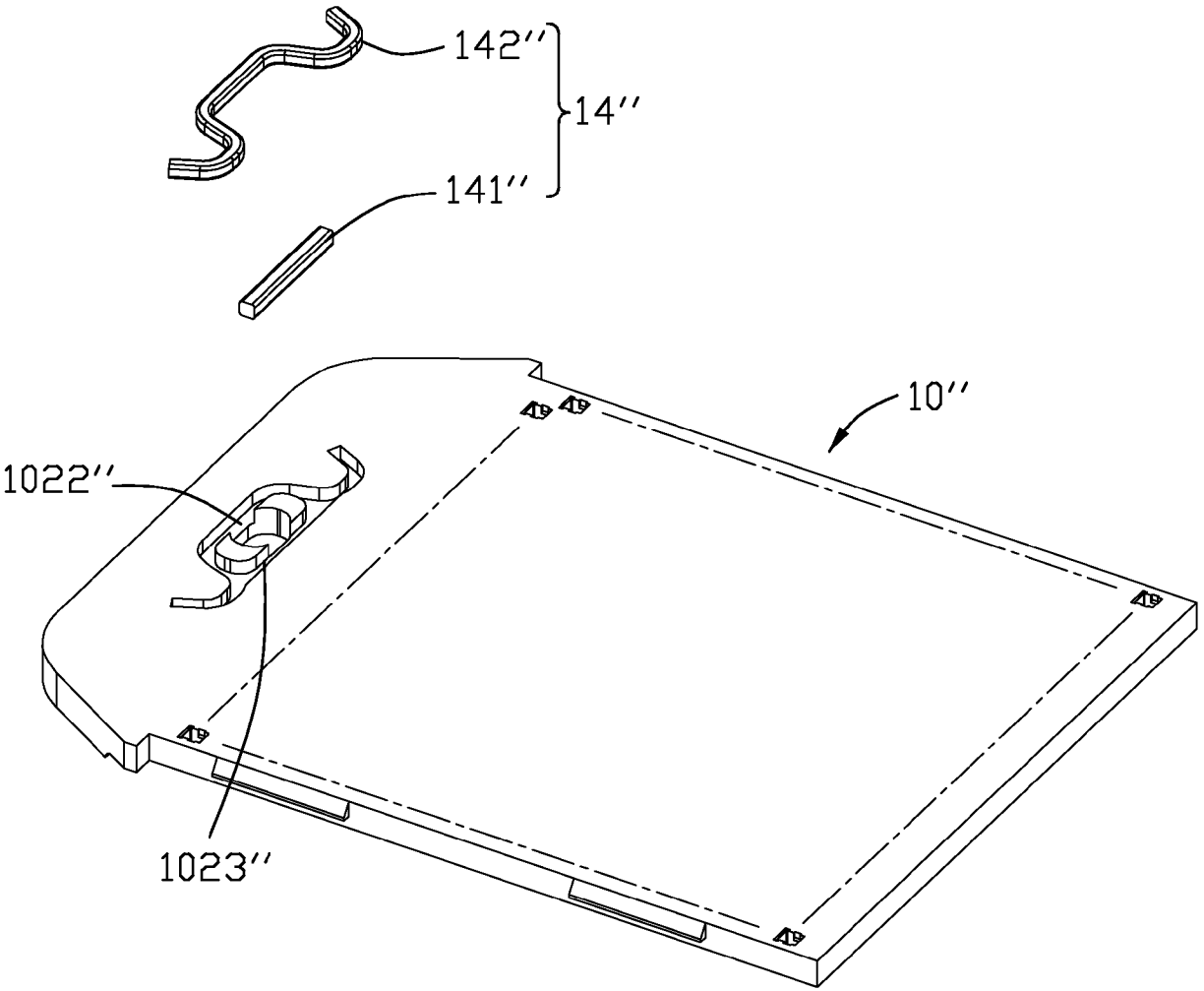
FIG. 6 is an exploded view of the base plate and the base of a third embodiment of the present invention.
Figure 7:
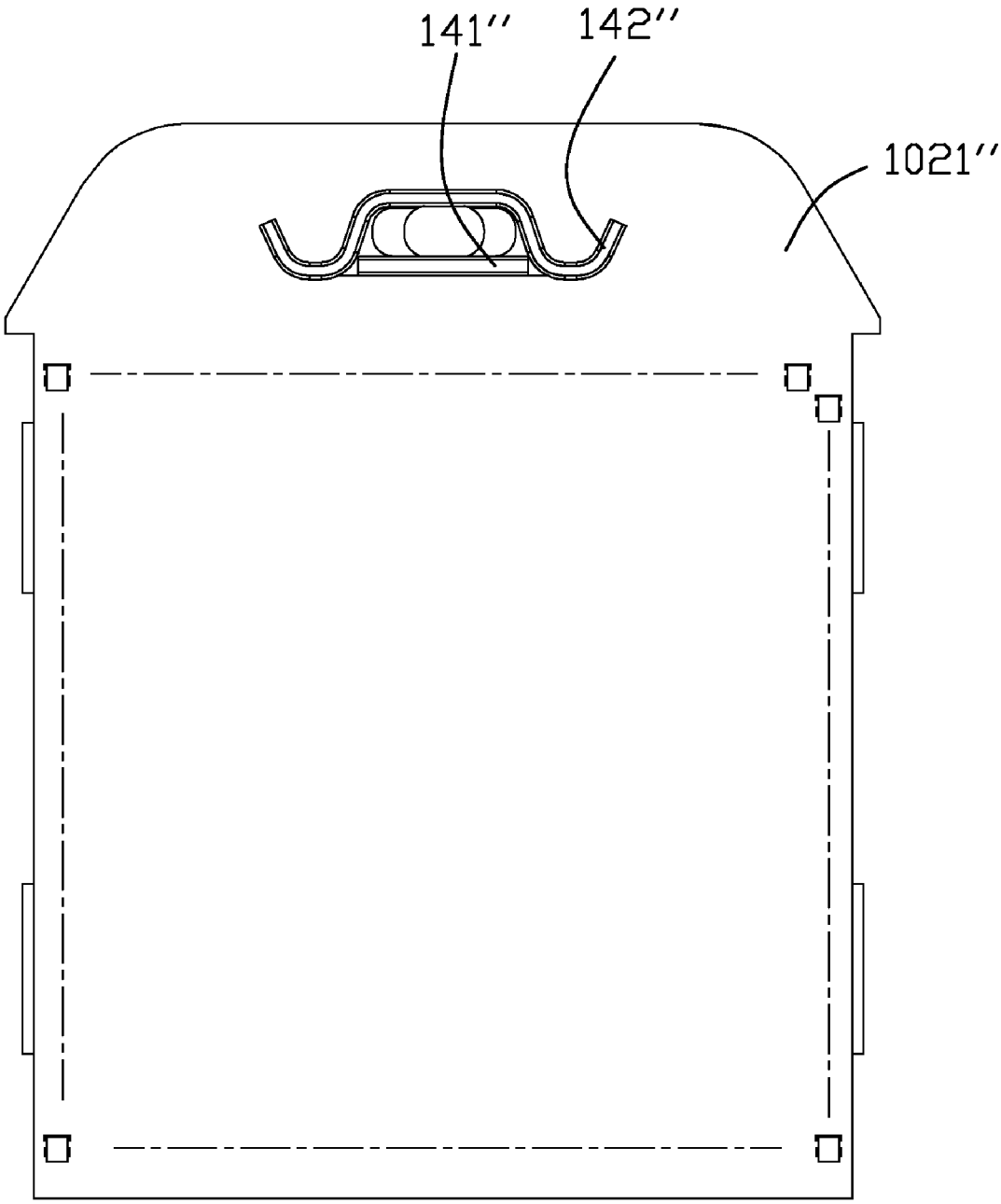
FIG. 7 is a top view of the base assembled with the bottom plate in FIG. 6.

Referring to FIGS. 6 to 7, showing a third embodiment of the present invention, the difference between the second and third embodiment is the channel 1023" is connected with the groove 1022'. When the first plate 142' is assembled into the groove 1022" and the second plate 141" is assembled into the channel 1023', the second plate 141" will engage with the first plate 142", which can enhance the intensity of the bottom plate 14".

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A socket connector, comprising:

a base having a body portion with a plurality of passageways defined therein, each of the passageways associated with a contact therein, the base further defining a bottom hole with a first and second reinforced discrete metallic ribs secured in a groove and a channel defined on the base, tangent and overlapping to periphery of the bottom hole;

a cover slidably mounted on the base covering substantially the body portion of the base, capable of moving to and from between first and second positions, and having a head portion with a cover plate corresponding to the bottom hole assembled to the underside of the head portion of the cover, the cover plate defining a through hole substantially in-line with the bottom hole when the cover is located at the first position; and a cam actuator including cam shaft having a driver rotationally sitting on the cover plate of the cover, and the cam shaft extending through the through hole, the cam actuator including a cam portion offset from the cam shaft and located in the through hole of the cover plate to drive the cover moving between first and second positions wherein the groove and the channel are disconnected with each other via partition walls.

2. The socket connector as recited in claim 1, wherein the bottom hole of the base is a substantially oblong shape.

3. The socket connector as recited in claim 1, the first reinforced metallic rib includes first engaging portion securely retained within the groove the base around the bottom hole.

4. The socket connector as recited in claim 1, wherein the driver includes a protrusion capable of indicating the cover is located in the first and second positions.

5. The socket connector as recited in claim 4, wherein the head portion of the cover is imprinted with indicators associated with the protrusion to identify the cover is located at the first and second positions.

6. The socket connector as recited in claim 1, wherein the cam shaft reaching to the bottom hole of the base is snugly sandwiched by the first and second reinforced metallic ribs.

7. The socket connector as recited in claim 1, wherein the groove has a substantially curvilinear shape and the channel is a substantially linear shape.

8. The socket connector as recited in claim 7, wherein the bottom hole is substantially surrounded by the groove and the channel.

9. The socket connector as recited in claim 7, wherein the first curvilinear groove includes a loop section substantially surrounding the bottom hole.

10. An electrical connector comprising:

an insulative base defining a first hole and a groove communicatively beside the first hole;

an insulative cover mounted upon the base and moveable relative to the base in a front-to-back direction, said cover defining a second hole;

a protection mechanism have a metallic cover part embedded in the cover and defining a third hole, and a metallic bottom part received in the groove; and a cam actuator having different sections with different diameters at different levels in an axial direction perpendicular to said front-to-back direction and respectively received in the corresponding first, second and third holes, respectively; wherein the bottom part is configured to provide resiliency thereof during engagement with the corresponding section in a radial direction perpendicular to said axial direction; wherein the bottom part includes an elongated piece with two opposite side ends in a free manner within the groove so as to provide said resiliency of the bottom part during engagement with the corresponding section of the cam actuator in said redial direction; wherein the corresponding section of the cam actuator intimately confronts, at the same level, the base in a transverse direction perpendicular to both said radial direction and said axial direction; wherein said bottom part further includes another elongated piece being discrete from said elongated piece without connection therebetween and communicatively located beside the first hole opposite to said elongated piece while cooperating with said elongated piece to sandwich the corresponding section therebetween in said front-to-back direction; wherein said radial direction is parallel to said front-to-back direction and said side end extends in a curved manner; and wherein the first hole and the groove are laterally disconnected with each other via partition walls.

11. An electrical connector comprising:

an insulative base defining a first hole, a groove and a channel communicatively beside the first hole;

an insulative cover mounted upon the base and moveable relative to the base in a front-to-back direction, said cover defining a second hole;

a protection mechanism have a metallic cover part embedded in the cover and defining a third hole, and a metallic bottom part configured by first and second discrete ribs received in the groove and the channel, respectively; and a cam actuator having different sections with different diameters at different levels in an axial direction perpendicular to said front-to-back direction and respectively received in the corresponding first, second and third holes, respectively; wherein the first and second discrete ribs are configured to provide overall rigidity thereof during engagement with the corresponding section in said front-to-back direction; wherein the corresponding section of the cam, which engages the first and second discrete ribs are in the front-to-back section, intimately confronts the base at the same levels in a transverse direction perpendicular to both said front-to-back direction and said axial direction the first hole and the channel are laterally disconnected with the groove via partition walls.

* * * * *